US005881683A

United States Patent [19]

Ban et al.

[11] Patent Number: 5,881,683

[45] Date of Patent: Mar. 16, 1999

[54] VISCOUS FLUID TYPE HEAT GENERATOR WITH MEANS FOR ENHANCING HEAT TRANSFER EFFICIENCY

[75] Inventors: Takashi Ban; Nobuaki Hoshino; Hajime Ito, all of Kariya; Shozo Tatematsu, Nagoya; Toshio Morikawa, Toyota; Toshihiro Oshima, Nagoya; Shinji Aoki, Kariya, all of Japan

[73] Assignee: Kabushiki Kaisha Toyoda Jidoshokki Seisakusho, Kariya, Japan

[21] Appl. No.: 41,268

[22] Filed: Mar. 12, 1998

[30] Foreign Application Priority Data

Mar. 14, 1997 [JP] Japan ..... 9-061115

[51] Int. Cl.[6] ..... F22B 3/06

[52] U.S. Cl. ..... 122/26; 126/247

[58] Field of Search ..... 122/26; 126/247

[56] References Cited

U.S. PATENT DOCUMENTS 4,277,020 7/1981 Grenier ..... 122/26

5,743,467 4/1998 Ban et al. ..... 122/26

FOREIGN PATENT DOCUMENTS 2246823 10/1990 Japan .

*Primary Examiner*—Teresa Walberg

*Assistant Examiner*—Jiping Lu

*Attorney, Agent, or Firm*—Burgess, Ryan & Wayne

[57] ABSTRACT

A viscous fluid type heat generator which includes a housing assembly defining a heat generating chamber and a heat receiving chamber arranged adjacent to the heat generating chamber via a partition wall disposed therebetween. A rotor element is mounted to be rotated by a drive shaft for rotation within the heat generating chamber. A viscous fluid is held in a gap defined between the inner wall surfaces of the heat generating chamber and the outer faces of the rotor element, for heat generation under shearing stress applied by the rotation of the rotor element. A heat exchanging fluid circulates through the heat receiving chamber to receive heat transferred through the partition wall from the heat generating chamber. A plurality of grooves, protuberances or expression are formed on at least one of the inner wall surfaces of the heat generating chamber to increase the total heat transfer surface area in the inner wall surfaces, and thus enhance a heat transfer efficiency through the partition wall. The density of arrangement of the grooves in the outer peripheral area of the inner wall surface is larger than that in the inner peripheral area of the inner wall surface.

8 Claims, 4 Drawing Sheets

VISCOUS FLUID TYPE HEAT GENERATOR WITH MEANS FOR ENHANCING HEAT TRANSFER EFFICIENCY

BACKGROUND OF THE INVENTION

1. Field of the Invention

The present invention relates to a viscous fluid type heat generator in which a viscous fluid is subjected to a shearing action or stress in a heat generating chamber to generate heat that is in turn transferred to a heat exchanging fluid circulating through a heat receiving chamber to be carried by the heat exchanging fluid to a desired area to be heated. The present invention may be embodied, for example, as a supplementary heat source incorporated in a vehicle heating system, but it will be appreciated that it is also useful in other applications.

2. Description of the Related Art

Viscous fluid type heat generators used as supplementary heat sources incorporated in a vehicle heating system are known in the art. For example, Japanese Unexamined Patent Publication (Kokai) No. 2-246823 (JP-A-2-246823) discloses such a viscous fluid type heat generator. In this viscous fluid type heat generator, a front housing and a rear housing are combined and fastened together with through bolts, to define therein a heat generating chamber and a heat receiving chamber arranged outside the heat generating chamber to surround the same. The heat generating chamber is isolated from the heat receiving chamber by a partition wall through which heat is exchanged between a viscous fluid in the heat generating chamber and a heat exchanging fluid in the heat receiving chamber. The heat exchanging fluid is circulated and introduced through an inlet port into the heat receiving chamber and delivered through an outlet port from the heat receiving chamber to an external heating circuit.

A drive shaft is supported for rotation by a bearing in the front housing, and a rotor element is fixedly mounted on the drive shaft to be rotatable within the heat generating chamber. The rotor element includes outer faces arranged face-to-face with the inner wall surfaces of the heat generating chamber to define therebetween small gaps in the shape of labyrinth grooves. The viscous fluid, such as silicone oil, is supplied into the heat generating chamber to fill the small gaps between the outer faces of the rotor element and the inner wall surfaces of the heat generating chamber. The small gaps shaped as labyrinth grooves are uniformly defined in a radial direction of the heat generating chamber and of the rotor element.

When the output torque of the vehicle engine is transferred to the drive shaft of the viscous fluid type heat generator to rotationally drive the drive shaft, the rotor element is also rotated within the heat generating chamber. At this time, the rotating rotor element provides a shearing action or shearing stress to the viscous fluid held in the small gaps between the inner wall surfaces of the heat generating chamber and the outer faces of the rotor element, whereby the viscous fluid generates heat. The generated heat is then transferred through the partition wall from the viscous fluid to the circulating heat exchanging fluid, and the heat exchanging fluid carries the transferred heat to the heating circuit of the vehicle heating system to heat a passenger compartment.

In the above-mentioned conventional viscous fluid type heat generator, the small gaps between the inner wall surfaces of the heat generating chamber and the outer faces of the rotor element are shaped as labyrinth grooves, and thus serve to increase a total heat transferring surface area of the inner wall surfaces of the heat generating chamber and to improve, in some degree, a heat transfer efficiency through the partition wall between the heat generating chamber and the heat receiving chamber. However, since the small gaps shaped as labyrinth grooves are uniformly defined in a radial direction of the heat generating chamber, the heat of the viscous fluid especially held in the outer peripheral region of the small gaps, which tends to rise up to the relatively high temperature, cannot be sufficiently and effectively transferred through the partition wall to the heat exchanging fluid in the heat receiving chamber. As a result, the temperature of the viscous fluid held in the small gaps in the heat generating chamber rises to an extremely high level, so that the degradation of the viscous fluid is accelerated, which in turn results in the reduction of heat generation accomplished by the conventional viscous fluid type heat generator.

SUMMARY OF THE INVENTION

Therefore, an object of the present invention is to provide a viscous fluid type heat generator, which improves heat transfer efficiency through the partition wall between the heat generating chamber and the heat receiving chamber, and thus prevents the degradation of the viscous fluid in the heat generating chamber due to the extremely high temperature rise of the viscous fluid, to improve the durability of the viscous fluid.

In accordance with the present invention, there is provided a viscous fluid type heat generator comprising a housing assembly defining therein a heat generating chamber in which heat is generated, the heat generating chamber having inner wall surfaces thereof, and a heat receiving chamber arranged adjacent to the heat generating chamber via a partition wall disposed therebetween, the heat receiving chamber permitting a heat exchanging fluid to circulate through the heat receiving chamber to thereby receive heat transferred through the partition wall from the heat generating chamber; a drive shaft supported by the housing assembly to be rotatable about an axis of rotation of the drive shaft, the drive shaft being operationally connected to an external rotation-drive source; a rotor element mounted to be rotationally driven by the drive shaft for rotation within the heat generating chamber, the rotor element having outer faces confronting the inner wall surfaces of the heat generating chamber via a predetermined gap defined therebetween; a viscous fluid, held in the gap defined between the inner wall surfaces of the heat generating chamber and the outer faces of the rotor element, for heat generation under a shearing stress applied by the rotation of the rotor element; and surface increasing means for enhancing the heat transfer efficiency through the partition wall between the heat generating chamber and the heat receiving chamber, the surface increasing means being provided integrally on at least one of the inner wall surfaces of the heat generating chamber to increase a total heat transfer surface area in the inner wall surfaces, an increment of a heat transfer surface area in an outer peripheral area of the at least one inner wall surface being larger than an increment of a heat transfer surface area in an inner peripheral area of the at least one inner wall surface.

In this viscous fluid type heat generator, it is preferred that the housing assembly includes front and rear partition plates constituting the partition wall, the front and rear partition plates having a respective one of the inner wall surfaces of the heat generating chamber, on both of which the surface increasing means is provided.

Also, it is advantageous that the surface increasing means comprises a plurality of depressions integrally formed on at least one of the inner wall surfaces of the heat generating chamber, a density of arrangement of the depressions in the outer peripheral area of the at least one inner wall surface being larger than the density of arrangement of the depressions in the inner peripheral area of the at least one inner wall surface.

In this arrangement, the plurality of depressions may include two sets of radially extending plural grooves arranged side by side in a circumferential direction, each of the grooves of a first groove set having a length larger than a length of each of the grooves of a second groove set, the first groove set being provided over substantially an entire area of the at least one inner wall surface, the second groove set being provided only in the outer peripheral area.

Alternatively, the plurality of depressions may include one set of radially extending plural grooves arranged side by side in a circumferential direction, the set of grooves being provided only in the outer peripheral area.

Yet alternatively, the plurality of depressions may include a set of plural annular grooves arranged concentrically, a radial distance between adjacent grooves in the outer peripheral area being smaller than radial distance between adjacent grooves in the inner peripheral area.

It is further advantageous that the surface increasing means comprises a plurality of projections integrally formed on at least one of the inner wall surfaces of the heat generating chamber, density of arrangement of the projections in the outer peripheral area of the at least one inner wall surface being larger than the density of arrangement of the projections in the inner peripheral area of the at least one inner wall surface.

In this arrangement, the plurality of projections may include a set of plural protuberances arranged in a certain distribution, a distance between adjacent protuberances in the outer peripheral area being smaller than the distance between adjacent protuberances in the inner peripheral area.

BRIEF DESCRIPTION OF THE DRAWINGS

The above and other objects, features and advantages of the present invention will become more apparent from the following description of preferred embodiments in connection with the accompanying drawings, in which.

DESCRIPTION OF THE PREFERRED EMBODIMENTS

Figure 1:
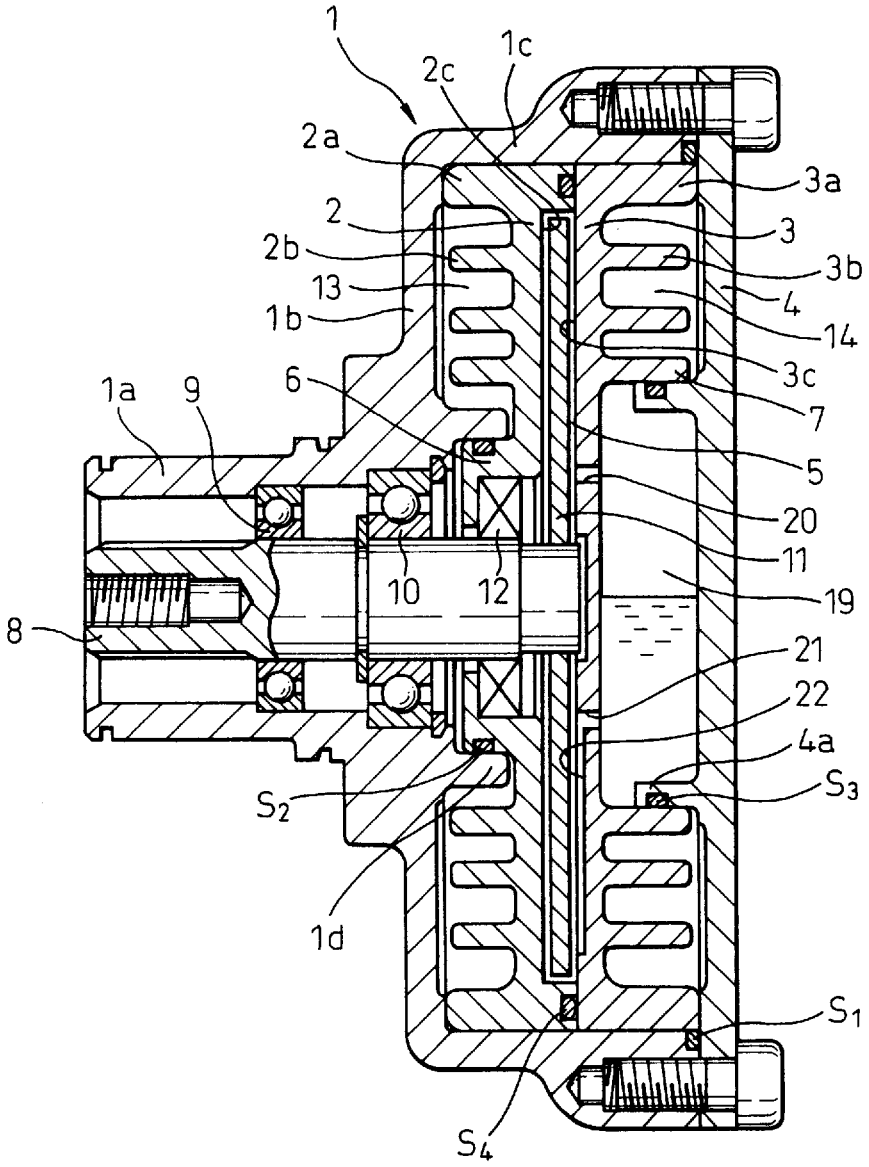
FIG. 1 is a longitudinal sectional view of a viscous fluid type heat generator according to the present invention.

Referring now to the drawings, wherein the same or similar components are denoted by the same reference numerals, FIG. 1 shows a viscous fluid type heat generator according to the present invention, and clarifies a common structure of the viscous fluid type heat generator according to the various embodiments as described later.

The heat generator of FIG. 1 includes a front housing body 1, a front partition plate 2, a rear partition plate 3 and a rear housing body 4, which are assembled as mentioned below to form a housing assembly of the heat generator. The front housing body 1 includes a hollow, cylindrical center boss la axially frontwardly (leftwardly, in the figure) extending from a base wall section 1*b* to define a center through bore in the center boss, and an outer cylindrical peripheral wall 1*c* rearwardly (rightwardly, in the figure) extending from the base wall section 1*b* to define a cup-shaped recess inside the peripheral wall 1*c*. The center boss 1*a* is adapted to accommodate drive shaft 8 to be joined with a power transmission mechanism such as a clutch unit (not shown).

The front and rear partition plates 2 and 3 are stacked with each other and are housed in the cup-shaped recess of the front housing body 1. The front housing body 1 is closed at a rear opening end of the cylindrical peripheral wall 1*c* thereof by the rear housing body 4 having a generally flat plate shape, and encloses the stacked front and rear partition plates 2, 3 in cooperation with the rear housing body 4. The rear housing body 4 is axially and tightly combined with the front housing body 1, by a plurality of screw bolts, through the interposition of an O-ring $S_1$ hermetically sealing between an outer peripheral region of the rear housing body 4 and a rear end face of the cylindrical peripheral wall 1*c*.

The front partition plate 2 includes a radially outer annular part and a center cylindrical part axially frontwardly and integrally extending from an inner extremity of the annular part. The annular part of the front partition plate 2 is provided with an outer peripheral rim 2*a* which axially frontwardly and integrally projects along an outer extremity of the annular part to be fitted inside the cylindrical peripheral wall 1*c* of the front housing body 1.

The rear partition plate 3 includes a radially outer annular part and a center flat part integrally extending from an inner extremity of the annular part. The annular part of the rear partition plate 3 is provided with an outer peripheral rim 3*a* which axially rearwardly and integrally projects along an outer extremity of the annular part to be fitted inside the cylindrical peripheral wall 1*c* of the front housing body 1. The front and rear partition plates 2, 3 are securely held between the front and rear housing bodies 1, 4 by the abutment of a front end of the rim 2*a* with the base wall section 1*b* and the abutment of a rear end of the rim 3*a* with the rear housing body 4.

A rear face of the front partition plate 2 is provided with an annular recess formed therein. An annular rear face 2*c* and a cylindrical circumferential face of the annular recess formed in the front partition plate 2 cooperate with the front face 3*c* of the rear partition plate 3 to define a heat generating chamber 5, into which a viscous fluid, such as a silicone oil, is introduced. Thus, the annular rear face 2*c* and the cylindrical circumferential face of the annular recess of the front partition plate 2 as well as the front face 3*c* of the rear partition plate 3 form the inner wall surfaces of the heat generating chamber 5. An O-ring $S_4$ is interposed, and hermetically seals, between mutually contacted surfaces of the partition plates 2, 3, located radially outside the heat generating chamber 5.

A drive shaft 8, typically positioned in a substantially horizontal state, is supported by a pair of bearings 9 and 10 located inside the center boss 1*a* of the front housing body 1. The drive shaft 8 penetrates in a non-contact state through a center hole formed in the center cylindrical part of the front partition plate 2 to extend in both interior spaces of the center boss 1*a* and the center cylindrical part. An axial rear end of the drive shaft 8 reaches to the heat generating chamber 5 which directly communicates with the interior space of the center cylindrical part of the front partition plate 2. A shaft sealing device 12 is disposed in the interior space of the center cylindrical part to surround the drive shaft 8, whereby the heat generating chamber 5, as well as the interior space of the center cylindrical part, are sealed in a fluid-tight manner from the exterior of the heat generator.

A rotor element 11 in the shape of flat circular disc is mounted and tightly fitted on the rear end of the drive shaft 8. The rotor element 11 is arranged within the heat generating chamber 5 in such a manner as to be rotatable by the drive shaft 8 about the generally horizontal rotation axis thereof. The rotor element 11 has circular axially opposed faces and a circumferential face, which form the outer faces of the rotor element 11. The outer faces of the rotor element 11 do not come into contact with the inner wall surfaces of the heat generating chamber 5 at any time, and thus defining therebetween a relatively small gap for holding a viscous fluid.

The center cylindrical part of the front partition plate 2 is provided with a cylindrical support 6 fitted inside a corresponding cylindrical support 1*d* rearwardly and integrally extending from a generally inner extremity of the base wall section 1*b* of the front housing body 1. An O-ring $S_2$ is interposed between these cylindrical supports 1*d*, and 6 to hermetically seal therebetween, while allowing the slight axial movement thereof relative to each other.

The annular part of the front partition plate 2 is also provided on a front face thereof with three C-shaped ridges 2*b* axially frontwardly and integrally projecting from the front face. The C-shaped ridges 2*b* concentrically extend around the cylindrical support 6 and inside the outer peripheral rim 2*a*. Between circumferential opposed ends of each C-shaped ridge 2*b*, a division wall (not shown) axially frontwardly and integrally projects from the front face and radially outwardly extends from the cylindrical support 6 provided.

A rear face of the base wall section 1*b* of the front housing body 1 cooperates with the front face of the annular part of the front partition plate 2, involving the faces of peripheral rim 2*a*, C-shaped ridges 2*b*, cylindrical support 6 and division wall, to define a C-shaped front heat receiving chamber 13 arranged near the front side of the heat generating chamber 5, into which a heat exchanging fluid is introduced. The front heat receiving chamber 13 is separated in a fluid-tight manner from the heat generating chamber 5 and from the ambient atmosphere by the front partition plate 2 interposed therebetween and the O-rings $S_1$, $S_2$.

The front ends of the C-shaped ridges 2*b* are spaced from the rear face of the base wall section 1*b*, and the C-shaped ridges 2*b* define a generally circular passage of the heat exchanging fluid in the front heat receiving chamber 13 in cooperation with the division wall. An inlet port (not shown) and an outlet port (not shown) are formed in the cylindrical peripheral wall 1*c* of the front housing body 1 at respective positions adjacent to the opposite sides of the division wall to be fluidly communicated with the circular passage.

Thus, the heat exchanging fluid circulating through a heating circuit (not shown) of a vehicle heating system is introduced through the inlet port into the front heat receiving chamber 13, and is discharged from the heat receiving chamber 13 through the outlet port into the heating circuit.

On the other hand, the annular part of the rear partition plate 3 is provided with a cylindrical support 7 axially rearwardly and integrally extending from an inner extremity of the annular part. The cylindrical support 7 is fitted outside a corresponding cylindrical support 4*a* frontwardly and integrally extending from the rear housing body 4. An O-ring $S_3$ is interposed between these cylindrical supports 4*a*, 7 to hermetically seal therebetween, while allowing the slight axial movement thereof relative to each other.

The annular part of the rear partition plate 3 is also provided on a rear face thereof with two C-shaped ridges 3*b* axially rearwardly and integrally projecting from the rear face. The C-shaped ridges 3*b* concentrically extend around the cylindrical support 7 and inside the outer peripheral rim 3*a*. Between circumferential opposed ends of each C-shaped ridge 3*b*, a division wall (not shown) axially rearwardly and integrally projects from the rear face and radially outwardly extends from the cylindrical support 7.

A part of a front face of the rear housing body 4, in the area radially outside the cylindrical support 4*a*, cooperates with the rear face of the annular part of the rear partition plate 3, involving the faces of peripheral rim 3*a*, C-shaped ridges 3*b*, cylindrical support 7 and division wall, to define a C-shaped rear heat receiving chamber 14 arranged near the rear side of the heat generating chamber 5, into which the heat exchanging fluid is introduced. The rear heat receiving chamber 14 is separated in a fluid-tight manner from the heat generating chamber 5 and from the ambient atmosphere by the rear partition plate 3 interposed therebetween and the O-ring $S_1$, $S_3$ and $S_4$.

The rear ends of the C-shaped ridges 3*b* are spaced from the front face of the rear housing body 4, and the C-shaped ridges 3*b* define a generally circular passage of the heat exchanging fluid in the rear heat receiving chamber 14 in cooperation with the division wall. The above-mentioned inlet and outlet ports (not shown) are also arranged at respective positions adjacent to the opposite sides of the division wall in the rear heat receiving chamber 14 to be fluidly communicated with the circular passage therein. Thus, the heat exchanging fluid is also introduced through the inlet port into the rear heat receiving chamber 14, and is also discharged from the heat receiving chamber 14 through the outlet port into the heating circuit (not shown) of the vehicle heating system.

Another part of the front face of the rear housing body 4, in the area radially inside the cylindrical support 4*a*, cooperates with a rear face of the center flat part of the rear partition plate 3, to define a fluid storing chamber 19 arranged near the rear side of the heat generating chamber 5. The fluid storing chamber 19 is separated in a fluid-tight manner from the rear heat receiving chamber 14 by the O-ring $S_3$.

The rear partition plate 3 is provided in the center flat part thereof with a fluid withdrawing passageway 20 and a fluid supply passageway, which fluidly communicates the heat generating chamber 5 with the fluid storing chamber 19. The fluid withdrawing passageway 20 opens to the upper region of the heat generating chamber 5, and serves to withdraw a viscous fluid held in the gap in the heat generating chamber 5 to the fluid storing chamber 19. The fluid supply passageway, including a hole 21 and a channel 22 connected to each other, opens to the lower region of the heat generating chamber 5, and serves to supply a viscous fluid stored in the fluid storing chamber 19 to the heat generating chamber 5.

In this manner, the gap, defined between the inner wall surfaces of the heat generating chamber 5 and the outer faces of the rotor element 11, and the fluid storing chamber 19 form a fluid-tight chamber which is constantly filled with a viscous fluid, such as a silicone oil, and a gaseous material.

Figure 2:
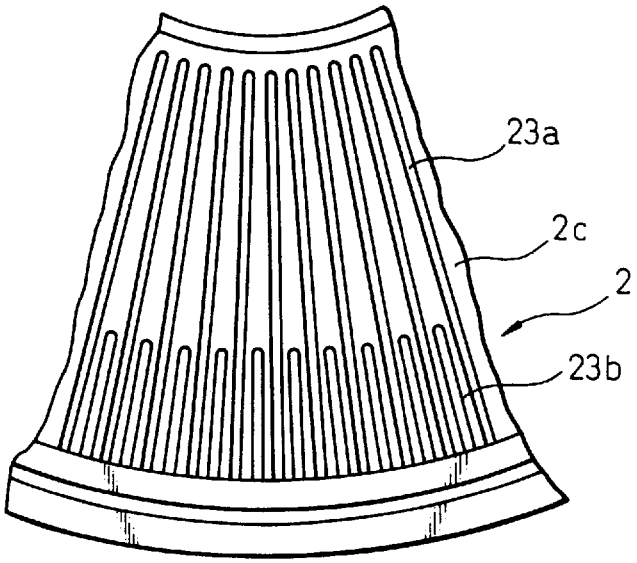
FIG. 2 is a back side view of a part of a front partition plate used in a first embodiment of the viscous fluid type heat generator.

The above-mentioned viscous fluid type heat generator according to the present invention further includes means for enhancing a heat transfer efficiency through at least one of the front and rear partition plates 2, 3 between the heat generating chamber 5 and at least one of the front and rear heat receiving chambers 13, 14. FIG. 2 shows the means for enhancing the heat transfer efficiency, provided in the inner wall surfaces of the heat generating chamber 5, used in a first embodiment of the viscous fluid type heat generator.

As shown in FIG. 2, the enhancing means includes two sets of radially extending plural grooves 23*a* and 23*b* integrally formed on the annular rear face 2*c* of the annular recess formed in the rear face of the front partition plate 2 and arranged side by side at regular intervals in a circumferential direction. Each of the grooves 23*a* of one groove set has a length larger than that of each of the grooves 23*b* of another groove set. The longer grooves 23*a* radially extend over substantially the entire area of the annular rear face 2*c*. More specifically, each longer groove 23*a* extends from near the inner periphery of the annular bottom face 2*c* to the outer periphery of the rear force 2*c* of the front partition plate 2.

On the other hand, the shorter grooves 23*b* radially extend only in the outer peripheral area of the annular rear face 2*c*. More specifically, each shorter groove 23*b* extends from a radially midway point on the annular rear face 2*c*, located at a position spaced from a center of the heat generating chamber 5 by generally ⅘×R (R represents a radius of the heat generating chamber 5), to the outer periphery of the rear face 2*c*. This, the shorter groove 23*b* has a general length of ⅕×R.

It is preferred that both the longer groove 23*a* and the shorter groove 23*b* have widths of 0.5 mm and depths of 0.5 mm. The longer grooves 23*a* and the shorter grooves 23*b* are alternately arranged with each other in a circumferential direction over the entire area of the annular rear face 2*c*. Preferably, an angle defined between radial center lines of the adjacent longer and shorter grooves 23*a*, 23*b* is 3°.

The two sets of grooves 23*a*, 23*b* with different lengths serve to increase the total surface area acting as a heat transfer surface on the annular rear face 2*c* in the front partition plate 2, and thus can enhance the heat transfer efficiency through the front partition plate 2 between the heat generating chamber 5 and the front heat receiving chamber 13. Particularly, in the first embodiment, the number and the density of the arrangement of grooves, i.e., the increment of the heat transfer surface area, in the outer peripheral area of the annular rear face 2*c* is larger than that in the inner peripheral area of the latter due to the provision of the shorter grooves 23*b*.

Therefore, in the heat generator, of the first embodiment, the heat generated especially in the radially outer region of the gap in the heat generating chamber 5, which tends to rise up to the relatively high temperature, is efficiently transferred through the front partition plate 2. Consequently, it is possible to prevent the degradation of the viscous fluid in the heat generating chamber 5 due to the extremely high temperature rise of the viscous fluid, and thus improves the durability of the viscous fluid.

It will be appreciated that, when the respective depths of the longer and shorter grooves 23*a*, 23*b* are larger, and also when the respective widths of the longer and shorter grooves 23*a*, 23*b* and the angle defined between the center lines of the adjacent longer and shorter grooves 23*a*, 23*b* are smaller to increase the total number of longer and shorter grooves 23*a*, 23*b*, the total surface area acting as a heat transfer surface on the annular rear face 2*c* in the front partition plate 2 is increased, and thereby the heat transfer efficiency through the front partition plate 2 can be more effectively improved. However, in consideration of the productivity or mechanical strength of the front partition plate 2, it is preferred that the respective grooves 23*a*, 23*b* have depths in a range generally between 0.3 mm and 2.0 mm and widths in a range generally between 0.3 mm and 2.0 mm, and that the adjacent grooves 23*a*, 23*b* define an angle in a range generally between 1° and 10°.

It should be noted that the above-mentioned means for enhancing the heat transfer efficiency, i.e., the surface increasing means, embodied by the two sets of grooves 23*a*, 23*b* with different lengths, may also be provided on the front face 3*c* of the rear partition plate 3 in the same manner as in the front partition plate 2. Within the scope of the invention, the two sets of grooves 23*a*, 23*b* with different lengths, may be provided on at least one of the annular rear face 2*c* and the front face 3*c*.

When the viscous fluid type heat generator of the first embodiment is incorporated in a vehicle heating system, and when the drive shaft 8 is driven by a vehicle engine (not shown) via a power transmission mechanism, such as a pulley, an electromagnetic clutch, etc., the rotor element 11 is rotated within the heat generating chamber 5. Therefore, the viscous fluid such as silicone oil held in the gap between the inner wall surfaces of the heat generating chamber 5 and the outer faces of the rotor element 11 is subjected to a shearing action or shearing stress by the rotation of the rotor element 11. Consequently, the viscous fluid generates heat, which is transferred to a heat exchanging fluid, typically water, flowing through the front and rear heat receiving chambers 13 and 14. Then, the heat is carried by the heat exchanging fluid to a heating circuit of the heating system to warm an objective area of the vehicle, such as a passenger compartment.

In this situation, if the two sets of grooves 23*a*, 23*b* are formed on both the annular rear face 2*c* and the front face 3*c*, the heat transfer surface area in the inner wall surfaces of the heat generating chamber 5 is effectively increased by the grooves 23*a*, 23*b*, and thus the heat transfer efficiency through the front and rear partition plates 2, 3 between the heat generating chamber 5 (or the viscous fluid) and the front and rear heat receiving chambers 13, 14 (or the heat exchanging liquid) is effectively enhanced. Particularly, the density of the arrangement of grooves, i.e., the increment of the heat transfer surface area, in the outer peripheral areas of the inner wall surfaces of the heat generating chamber 5 is larger than that in the inner peripheral areas of the latter due to the provision of the shorter grooves 23*b*.

Therefore, the heat generated especially in the radially outer region of the gap in the heat generating chamber 5, which tends to rise up to the relatively high temperature, is efficiently transferred through the front and rear partition plates 2, 3. Consequently, it is possible to effectively prevent the degradation of the viscous fluid in the heat generating chamber 5 due to an extremely high temperature rise of the viscous fluid, and thus to improve the durability of the viscous fluid.

Further, in this heat generator, since the longer and shorter grooves 23*a*, 23*b*, embodying the means for enhancing the heat transfer efficiency, radially extend in the heat generating chamber 5 and also serve to partially increase the gap between the inner wall surfaces of the heat generating chamber 5 and the outer faces of the rotor element 11 at the positions of the grooves 23*a*, 23*b*, it is possible to improve the circulation flow of the viscous fluid, especially in a radial direction in the heat generating chamber 5.

Figure 3:
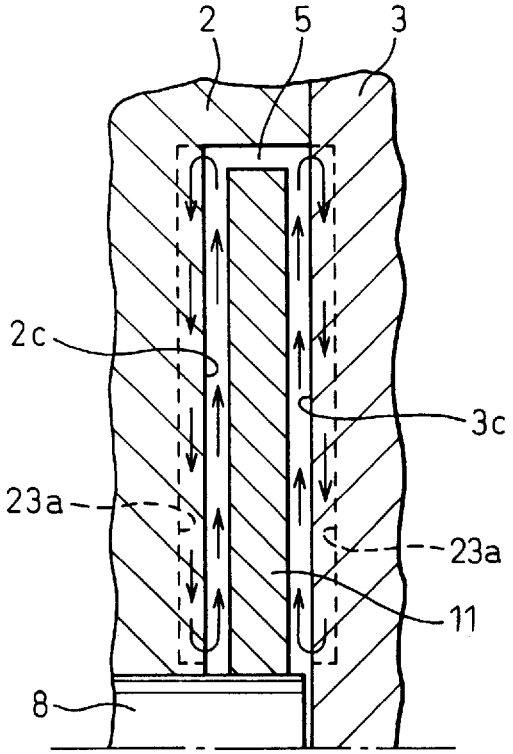
FIG. 3 is a partially enlarged sectional view illustrating direction of flow of a viscous fluid in a heat generating chamber, according to the first embodiment of FIG. 2.

As shown in FIG. 3, when the rotor element 11 rotates in the heat generating chamber 5, a part of the viscous fluid held in the gap, located adjacent to the outer faces of the rotor element, flows from the radially inner region of the gap to the radially outer region thereof, as shown by arrows, by a centrifugal force caused by the rotating rotor element 11. At the same time, the viscous fluid conveyed to the radially outer region of the gap flows back to the radially inner region, as shown by arrows, along the longer and/or shorter grooves 23*a*, 23*b* formed on the inner wall surfaces of the heat generating chamber 5. This results when the centrifugal force is stronger than the Weissenberg effect which has been ascertained to affect the flow of the viscous fluid in the gap in the heat generating chamber 5 according to the rotation speed of the rotor element 11.

To the contrary, when the Weissenberg effect is stronger than the centrifugal force, a part of the viscous fluid held in the gap, located adjacent to the outer faces of the rotor element, flows from the radially outer region of the gap to the radially inner region thereof (not shown) by the Weissenberg effect caused due to the rotating rotor element 11. At the same time, the viscous fluid gathered in the radially inner region of the gap flows back to the radially outer region along the longer and/or shorter grooves 23*a*, 23*b*.

In this manner, the viscous fluid can readily and surely circulate between the radially inner and outer regions in the gap in the heat generating chamber 5, since, especially in the first embodiment, the longer grooves 23*a* extend from the inner peripheral areas of the inner wall surfaces of the heat generating chamber 5 to the outer peripheral areas of the same. Consequently, it is possible to make uniform the temperature of the viscous fluid in the gap in the heat generating chamber 5, and thus to effectively suppress the extremely high temperature rise of the viscous fluid located in the radially outer gap region in the heat generating chamber 5.

Figure 4:
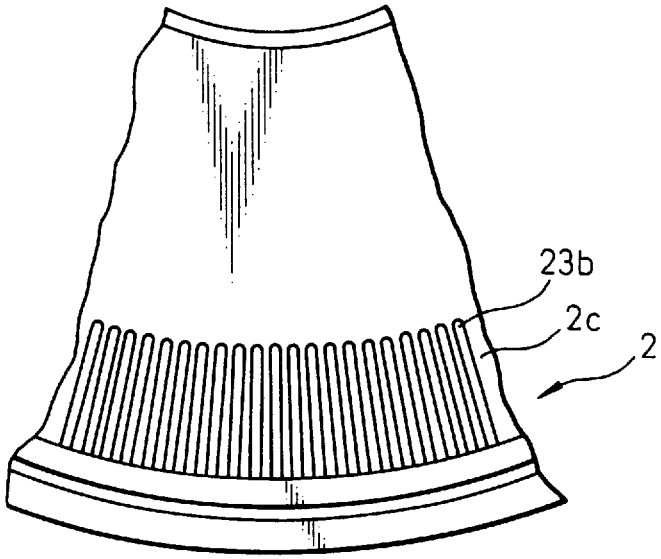
FIG. 4 is a back side view of a part of a front partition plate used in a second embodiment of the viscous fluid type heat generator.

FIG. 4 shows a means for enhancing the heat transfer efficiency, provided in the inner wall surfaces of the heat generating chamber 5, used in a second embodiment of the viscous fluid type heat generator. As shown in FIG. 4, the enhancing means, or surface increasing means, includes a set of radially extending plural grooves 23*b* integrally formed on the annular rear face 2*c* of the annular recess in the front partition plate 2 and arranged side by side at regular intervals in a circumferential direction.

The set of grooves 23*b* is similar to the set of shorter grooves 23*b* in the first embodiment, and each groove 23*b* radially extends only in the outer peripheral area of the annular bottom face 2*c*. More specifically, the set of grooves 23*b* in the second embodiment is constituted by replacing all of the longer grooves 23*a* in the first embodiment with the shorter grooves 23*b*, or only by deleting all longer grooves 23*a*. The grooves 23*b* in the second embodiment may also be provided on the front face 3*c* of the rear partition plate 3. The other features of the grooves 23*b* in the second embodiment are substantially identical to those in the first embodiment.

Therefore, in the second embodiment, it is possible to enhance the heat transfer efficiency through the front and/or rear partition plates 2, 3 between the heat generating chamber 5 and the front and/or rear heat receiving chambers 13, 14, particularly in the radially outer region of the gap in the heat generating chamber 5, and thus to improve the durability of the viscous fluid by preventing the degradation of the viscous fluid due to an extremely high temperature rise, without complicating the process of forming the grooves.

Figure 5:
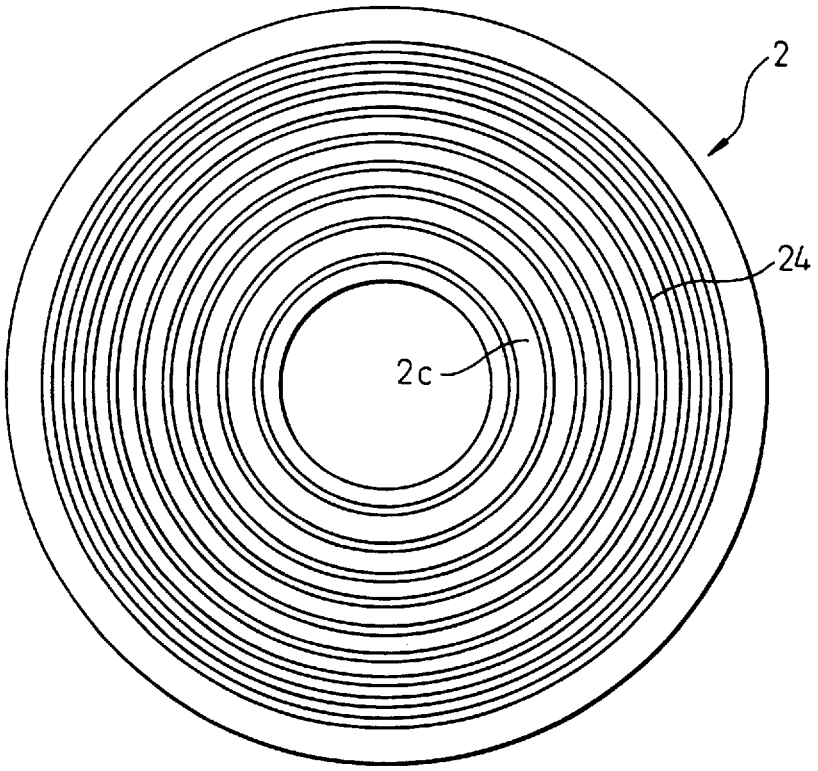
FIG. 5 is a back side view of a front partition plate used in a third embodiment of the viscous fluid type heat generator.

FIG. 5 shows the means for enhancing the heat transfer efficiency, provided in the inner wall surfaces of the heat generating chamber 5, used in a third embodiment of the viscous fluid type heat generator. As shown in FIG. 5, the enhancing means, or surface increasing means, includes a plurality of annular grooves 24 integrally formed on the annular rear face 2*c* of the annular recess in the front partition plate 2 and arranged concentrically with each other. The radial distance between adjacent grooves 24 arranged in the outer peripheral area of the annular rear face 2*c* is smaller than that in the inner peripheral area of the latter. Preferably, the radial distance between adjacent grooves 24 gradually decreases from the inner peripheral area to the outer peripheral area. Also, it is preferred that each groove 24 has a width of 0.5 mm and a depth of 0.5 mm.

The set of grooves 24 serves to increase the total surface area acting as a heat transfer surface on the annular bottom face 2*c* in the front partition plate 2, and thus can enhance the heat transfer efficiency through the front partition plate 2 between the heat generating chamber 5 and the front heat receiving chamber 13. Particularly, in the third embodiment, the number and the density of the arrangement of grooves, i.e., the increment of the heat transfer surface area, in the outer peripheral area of the annular bottom face 2*c* is larger than that in the inner peripheral area of the latter. The grooves 24 in the third embodiment may also be provided on the front face 3*c* of the rear partition plate 3.

Therefore, in the third embodiment, it is possible to enhance the heat transfer efficiency through the front and/or rear partition plates 2, 3 between the heat generating chamber 5 and the front and/or rear heat receiving chambers 13, 14, particularly in the radially outer region of the gap in the heat generating chamber 5, and thus to improve the durability of the viscous fluid by preventing the degradation of the viscous fluid due to an extremely high temperature rise.

As an alternative to the above embodiments, the grooves 23*a*, 23*b*, 24 may be replaced by projections or ridges (not shown) with the same arrangement as in the above embodiments.

Figure 6:
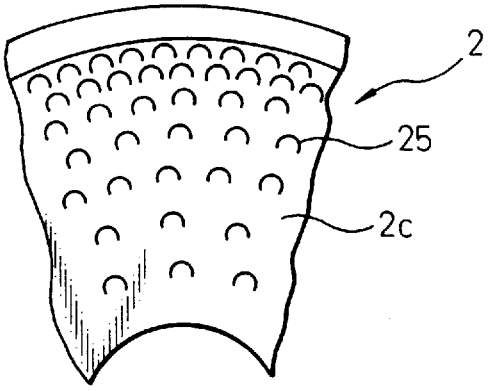
FIG. 6 is a back side view of a part of a front partition plate used in a fourth embodiment of the viscous fluid type heat generator.

FIG. 6 shows a means for enhancing the heat transfer efficiency, provided in the inner wall surfaces of the heat generating chamber 5, used in a fourth embodiment of the viscous fluid type heat generator. As shown in FIG. 6, the enhancing means, or surface increasing means, includes a set of plural small protuberances 25 integrally formed on the annular rear face 2*c* of the annular recess in the front partition plate 2 and arranged in a regular or random distribution. The distance between adjacent protuberances 25 arranged in the outer peripheral area of the annular rear face 2*c* may be smaller than that in the inner peripheral area of the latter. Preferably, each protuberances 25 has a hemispherical shape with a height of 0.15 mm and a diameter of 0.3 mm.

The set of protuberances 25 serves to increase the total surface area acting as a heat transfer surface on the annular rear face 2*c* in the front partition plate 2, and thus can enhance the heat transfer efficiency through the front partition plate 2 between the heat generating chamber 5 and the front heat receiving chamber 13. Particularly, in the fourth embodiment, the number and the density of the arrangement of protuberances, i.e., the increment of the heat transfer surface area, in the outer peripheral area of the annular rear face 2*c* is larger than that in the inner peripheral area of the latter. The protuberances 25 in the fourth embodiment may also be provided on the front face 3*c* of the rear partition plate 3.

Therefore, in the fourth embodiment, it is possible to enhance the heat transfer efficiency through the front and/or rear partition plates 2, 3 between the heat generating chamber 5 and the front and/or rear heat receiving chambers 13, 14, particularly in the radially outer region of the gap in the heat generating chamber 5, and thus to improve the durability of the viscous fluid by preventing the degradation of the viscous fluid due to an extremely high temperature rise.

In the alternative, the protuberances 25 may be replaced by small dimples (not shown). In both cases, it is preferred that each protuberance 25 or dimple has a height or depth in a range generally between 0.05 mm and 0.5 mm and a diameter in a range generally between 0.05 mm and 2.0 mm.

While the invention has been particularly shown and described with reference to preferred embodiments thereof, it will be understood by those skilled in the art that various changes and modifications may be made without departing from the spirit and scope of the invention. The scope of the invention is therefore to be determined solely by the appended claims.

We claim:

1. A viscous fluid type heat generator comprising:

a housing assembly defining therein a heat generating chamber in which heat is generated, said heat generating chamber having inner wall surfaces thereof, and a heat receiving chamber arranged adjacent to said heat generating chamber via a partition wall disposed therebetween, said heat receiving chamber permitting a heat exchanging fluid to circulate through said heat receiving chamber to thereby receive heat transferred through said partition wall from said heat generating chamber;

a drive shaft supported by said housing assembly to be rotatable about an axis of rotation of said drive shaft, said drive shaft being operationally connected to an external rotation-drive source;

a rotor element mounted to be rotationally driven by said drive shaft for rotation within said heat generating chamber, said rotor element having outer faces confronting said inner wall surfaces of said heat generating chamber via a predetermined gap defined therebetween;

a viscous fluid, held in said gap defined between said inner wall surfaces of said heat generating chamber and said outer faces of said rotor element, for heat generation under shearing stress applied by the rotation of said rotor element; and surface increasing means for enhancing the heat transfer efficiency through said partition wall between said heat generating chamber and said heat receiving chamber, said surface increasing means being provided integrally on at least one of said inner wall surfaces of said heat generating chamber to increase the total heat transfer surface area of said at least one of said inner wall surfaces, an increment of the heat transfer surface area in an outer peripheral area of said at least one inner wall surface being larger than the increment of the heat transfer surface area in an inner peripheral area of said at least one inner wall surface.

2. The viscous fluid type heat generator of claim 1, wherein said housing assembly includes front and rear partition plates constituting said partition walls, said front and rear partition plates compressing respective one of said inner wall surfaces of said heat generating chamber, on both of which said surface increasing means are provided.

3. The viscous fluid type heat generator of claim 1, wherein said surface increasing means comprises a plurality of depressions integrally formed on at least one of said inner wall surfaces of said heat generating chamber, a density of arrangement of said depressions in said outer peripheral area of said at least one inner wall surface being larger than the density of arrangement of said depressions in said inner peripheral area of said at least one inner wall surface.

4. The viscous fluid type heat generator of claim 3, wherein said plurality of depressions includes two sets of radially extending grooves arranged side by side in a circumferential direction, each of said grooves of a first groove set having a length longer than the length of each of said grooves of a second groove set, said first groove set being provided over substantially an entire area of said at least one inner wall surface, said second groove set being provided only in said outer peripheral area.

5. The viscous fluid type heat generator of claim 3, wherein said plurality of depressions includes one set of radially extending grooves arranged side by side in a circumferential direction, said set of grooves being provided only in said outer peripheral area.

6. The viscous fluid type heat generator of claim 3, wherein said plurality of depressions includes a set of annular grooves arranged concentrically, a radial distance between adjacent grooves in said outer peripheral area being smaller than radial distance between adjacent grooves in said inner peripheral area.

7. The viscous fluid type heat generator of claim 1, wherein said surface increasing means comprises a plurality of projections integrally formed on at least one of said inner wall surfaces of said heat generating chamber, a density of arrangement of said projections in said outer peripheral area of said at least one inner wall surface being larger than density of arrangement of said projections in said inner peripheral area of said at least one inner wall surface.

8. The viscous fluid type heat generator of claim 7, wherein said plurality of projections includes a set of protuberances arranged in certain distribution, a distance between adjacent protuberances in said outer peripheral area being smaller than the distance between adjacent protuberances in said inner peripheral area.

* * * * *

UNITED STATES PATENT AND TRADEMARK OFFICE

CERTIFICATE OF CORRECTION

PATENT NO. : 5,881,683

DATED : March 16, 1999

INVENTOR(S) : Takashi BAN, et al

It is certified that error appears in the above-identified patent and that said Letters Patent is hereby corrected as shown below:

Title page, In Item 73, the Assignees should be listed as
KABUSHIKI KAISHA TOYODA JIDOSHOKKI SEISAKUSHO
Kariya, Japan
and
Denso Corporation
Kariya, Japan Signed and Sealed this Twelfth Day of September, 2000

*Attest:*

Q. TODD DICKINSON

*Attesting Officer*

*Director of Patents and Trademarks*